US005860592A

United States Patent [19]

Dozier et al.

[11] Patent Number: 5,860,592

[45] Date of Patent: Jan. 19, 1999

[54] VARIABLE-AIR-VOLUME DIFFUSER WITH INDEPENDENT VENTILATION AIR ASSEMBLY AND METHOD

[75] Inventors: Jack Dozier, Doyline, La.; Robert S. Hunka, Oakland; James R. Kline, Moraga, both of Calif.

[73] Assignee: Acutherm L.P., Hayward, Calif.

[21] Appl. No.: 888,727

[22] Filed: Jul. 7, 1997

Related U.S. Application Data

[63] Continuation-in-part of Ser. No. 570,509, Dec. 11, 1995, Pat. No. 5,673,851.

[51] Int. Cl.[6] ..... F24F 13/16

[52] U.S. Cl. ..... 236/49.3; 236/49.5; 236/DIG. 19

[58] Field of Search ..... 236/49.3, 49.5, 236/DIG. 19; 165/123, 213

[56] References Cited

U.S. PATENT DOCUMENTS

| | | | |
|---|---|---|---|
| Re. 30,953 | 6/1982 | Vance et al. | 236/49.5 |
| 3,032,323 | 5/1962 | Church . | |
| 3,743,180 | 7/1973 | Perkins et al. | 236/1 C |
| 4,141,496 | 2/1979 | Duchek | 236/49 |
| 4,491,270 | 1/1985 | Brand | 236/49 |
| 4,509,678 | 4/1985 | Noll | 236/49 |
| 4,523,713 | 6/1985 | Kline et al. | 236/1 C |
| 4,537,347 | 8/1985 | Noll et al. | 236/49 |
| 4,623,090 | 11/1986 | Heger | 236/49 |
| 4,694,988 | 9/1987 | Carlson et al. | 236/87 |
| 4,821,955 | 4/1989 | Kline et al. | 236/49.3 |

*Primary Examiner*—William E. Tapolcai
*Attorney, Agent, or Firm*—Flehr Hohbach Test Albritton & Herbert LLP

[57] ABSTRACT

A variable-air-volume (VAV) conditioning system having at least one diffuser (27*a*–27*d*) for discharging supply air (SA) into a room (22*a*–22*d*) a flow control element (53) movably mounted in the diffuser for control of the volume of supply air (SA) discharged from the diffuser (27*a*–27*d*) in response to thermal loading in the room (22*a*–22*d*). The VAV system also includes a ventilation air source (41), independent of the supply air source (23), which is fluid coupled to a ventilation air opening defining structure (59), such as a nozzle, located in the diffuser housing (15) at a position downstream of the flow control element (53). A method for ensuring the flow of ventilation air (VA) into a room (22*a*–22*d*) including the step of discharging ventilation air (VA) through a ventilation air opening device (59) positioned in the diffuser housing (15) downstream of the diffuser flow control element (53) so that ventilation air flow is controlled independently of, and decoupled from, the variable flow rate of supply air (SA) which is controlled by the flow control element (53).

13 Claims, 4 Drawing Sheets

VARIABLE-AIR-VOLUME DIFFUSER WITH INDEPENDENT VENTILATION AIR ASSEMBLY AND METHOD

RELATED APPLICATION

The present application is a continuation-in-part of U.S. patent application Ser. No. 08/570,509 filed Dec. 11, 1995, now U.S. Pat. No. 5,693,851, allowed.

FIELD OF INVENTION

The present invention relates, in general, to air diffusers for heating and/or cooling of structures, and more particularly, the invention relates to variable-air-volume diffusers which employ temperature sensors to determine thermal loads and control the volume of air discharged in a room.

BACKGROUND OF THE INVENTION

Traditionally, heating, ventilating and air conditioning (HVAC) systems have been designed to mix heated or cooled air, for thermal loads, with outside air, for ventilation, at an air handling or processing unit. Mixed air is then delivered in a common duct system to the spaces to be conditioned. As used herein, it will be understood that the expressions "conditioned" and "conditioning" shall include any one or more of heating, cooling, ventilating or filtering and recycling air; and the expressions "ventilated" and "ventilation" shall include air which is taken into an HVAC system from outside the structure, as well as air which is returned from a room in the structure and filtered to remove contaminants, and mixtures of outside air and filtered return air. The addition of ventilation air to the supply air of a HVAC system is designed to prevent endless recycling of unfiltered system air and the attendant build up of undesirable air-born containments. In some urban environments, of course, it is not clear that the outside air is "fresh" or even as good as the returned supply air, nevertheless, the addition of ventilation air generally is believed to be highly desirable.

At the present time, the flow rate of ventilation air to be added to HVAC system supply air is often prescribed by ASHRAE Standard 62-1989. The ASHRAE Standard is set by American Society of Heating, Refrigeration and Air Conditioning Engineers, and it has been adopted by code in many states. Even when the ASHRAE Standard is not required by code, it is usually the industry standard. For offices, the present ASHRAE Standard for the flow of ventilation (outside and/or filtered) air into a room or office is a minimum of 20 cubic feet per minute (cfm) per person.

Thermal loads, however, determine the amount and temperature of the conditioned or supply air which must be used in a space to achieve the desired conditioning effects. Thermal loads in office spaces are usually determined by sensing the temperature in the room, and there can be little correlation between the thermal load and occupancy of a space in a modern office building. Thus, factors such as lighting, computer equipment and other heat sources can produce considerable variation of the thermal load from office to office independently of occupancy.

One of the most common HVAC systems employed in modern office buildings is the variable-air-volume (VAV) conditioning system. Such systems vary the volume of supply air discharged into a room in response to the thermal load demand, as determined by sensing the room air temperature. VAV systems offer a number of potential operating and cost advantages as compared to constant volume, variable temperature systems. As will be appreciated, however, if the ventilation air flow rate is prescribed by occupancy, and the thermal demand is not an absolute function of occupancy, the standard approach of simply adding ventilation air to the supply air will not provide offices with sufficient ventilation air when thermal loads are low. Thus, when the thermal load in an office is relatively low, the VAV air diffuser will close down and deliver less supply air, or even no supply air, to the office. Nevertheless, the office may have several occupants, and the quantity of air being discharged out of the VAV diffuser will not include sufficient ventilation air to meet the ASHRAE 62-1989 Standard, or other minimum ventilation standards or regulations.

One approach to this problem has been to increase the amount of ventilation air added to the supply air so that even under the lowest thermal loads, sufficient outside air will be included in the air discharged from the VAV device. The problem with this approach is that it requires conditioning of a much higher volume of ventilation air, with attendant increased costs. Another approach has been to add sufficient ventilation air to the central conditioning unit to meet the ASHRAE Standard, on average and simply disregard the fact that all spaces are not adequately ventilated. There is a liability exposure in such an approach when the problem of a "sick" buildings occurs. Thus, if health problems do arise in the building, and it is shown that many rooms fall below the ASHRAE Standard or other legal minimum ventilation standard, the addition of sufficient ventilation air to the system "on average" is not likely to be an acceptable solution nor an approach to avoiding liability.

A third prior art approach to adequate ventilation is to essentially duplicate the HVAC system with a parallel ventilation air system. Thus, a ventilation air treatment unit and blower, with separate ducts to each office, and separate ventilation air diffusers in each office are installed. This approach, however, creates an undesirable duplication of diffusers in each office, which can be unsightly as well as add extra expense.

VAV conditioning systems typically include a room air temperature sensing apparatus located in many, and often each, of the spaces which are conditioned. The room air temperature sensor can be located in a position which is remote from the supply air diffuser, or it can be located in the diffuser itself. One technique that is commonly employed in VAV systems, in order to ensure room air flow past the room air temperature sensing device, is to positively induce the flow of room air past the temperature sensing device. This is usually done by the discharge of supply air from the diffuser. Thus, a nozzle or orifice can be positioned for the discharge of a small volume of supply air from the diffuser, even when the diffuser is closed, so as to induce the flow of room air past the room air temperature sensor. This ensures that the room air temperature sensor is not sensing air temperature under stagnant conditions, and thus that the room air temperature sensor is more accurately measures average room temperature.

The discharge of a small volume of supply air to induce room air flow past temperature sensors has been used for many years in connection with thermally-powered VAV air diffusers. U.S. Pat. Nos. 4,509,678, 4,537,347 and 4,821,955, for example, all describe VAV diffusers which are thermally powered and include induction air discharge arrangements in which supply air is discharged into the room even when the diffuser is "closed" so as to induce room air flow past the temperature sensor mounted in the diffuser. The temperature sensors themselves are combination sensor-actuators which respond to temperature changes to produce displacement of VAV control vanes, dampers or disks through linkage assemblies in order to open and close the diffuser as the thermal load varies.

Accordingly, it is an object of the present invention to provide a VAV diffuser apparatus and method capable of meeting the ASHRAE 62-1989 Standard for ventilation, or other local ventilation standard, while still being highly efficient and capable of accommodating the conditioning of spaces having thermal loads which vary considerably.

Another object of the present invention is to provide a VAV diffuser system which is capable of discharging ventilation air into a space at a rate which is independent of, or decoupled from, the thermal load.

Still a further object of the present invention is to provide a thermally-powered diffuser which is capable of discharging ventilation air into a space at a rate sufficient to meet the ASHRAE 62-1989 Standard, or other local ventilation standards, under essentially thermal no-load conditions.

Another object of the present invention is to provide a method or process of ensuring the flow of sufficient ventilation air into a space being conditioned by VAV diffuser system so that thermal load variations do not reduce ventilation air flow below a desired threshold.

Still a further object of the present invention is to provide a VAV diffuser apparatus and method which is efficient to operate, suitable for retrofitting to existing VAV systems, and is inexpensive to construct, install and maintain.

The variable-air-volume diffuser system and method of the present invention have other objects and features of advantage which will be set forth in more detail in, and will be apparent from, the following Best Mode of Carrying Out the Invention and accompanying drawings.

DISCLOSURE OF THE INVENTION

The variable-air-volume diffuser of the present invention is comprised, briefly, of at least one diffuser formed for coupling to a supply air conduit and formed with a diffuser housing defining a discharge opening for discharge of supply air from a supply air source into a room or space of a structure, an air flow control element, such as a vane, disk or damper, movably mounted for control of the volume of supply air discharged through the discharge opening, an air flow control element displacement device coupled a room air temperature sensor and responsive to input from the room air temperature sensor to move the control element, a ventilation air nozzle or opening defining device mounted in said diffuser housing in a position downstream of the air flow control element and in a position for discharge of ventilation air from said discharge opening, and a ventilation air supply assembly separate from the supply air source and coupled to supply ventilation air to the ventilation nozzle for discharge through the diffuser housing independently of the discharge of supply air from the diffuser.

The method of ensuring the flow of ventilation air into a room of a structure being conditioned using a variable-air-volume system of the present invention is comprised, briefly, of the step of discharging ventilation air obtained from a ventilation air source separate from the supply air source, through a ventilation air opening defining device located in the diffuser housing downstream of the flow control element or diffuser vane in the diffuser housing.

BEST MODE OF CARRYING OUT THE INVENTION

Figure 1:
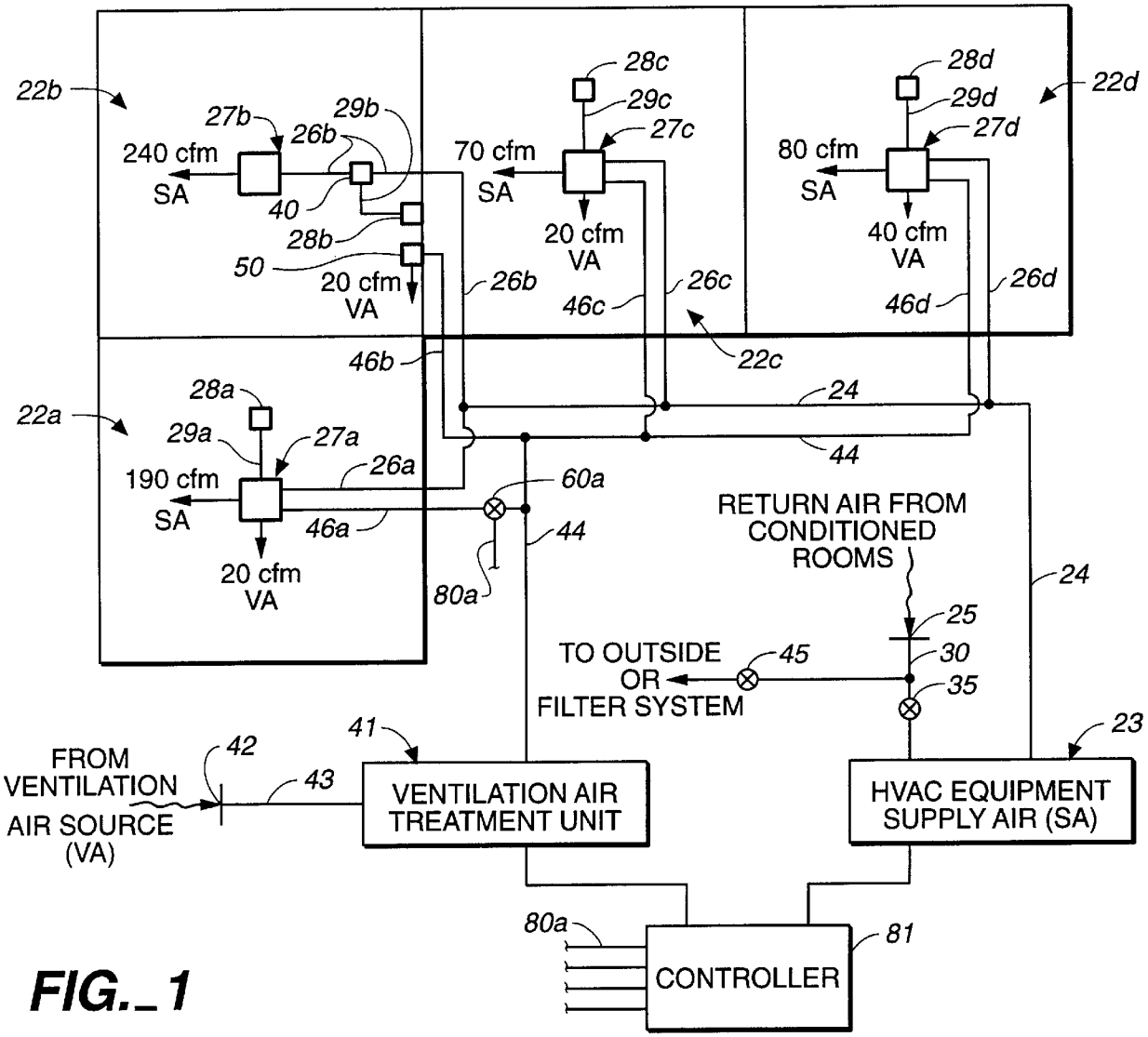
FIG. 1 is a top plan, schematic view of a structure having a plurality of spaces or rooms which are conditioned by a VAV system constructed in accordance with the present invention.

As shown in FIG. 1, a structure, generally designated 21, such an office building, home, school, etc., is illustrated which has a plurality of rooms 22*a*–22*d* that receive conditioned supply (heated/cooled/recycled) air from an HVAC source, generally designated 23, through a main supply air duct 24 having room branch supply air ducts 26*a*–26*d*. Mounted in each room 22*a*–22*d* is a diffuser 27*a*–27*d*, which diffusers are coupled to the respective branch supply air ducts or conduits 26*a*–26*d*. Room air temperature sensors 28*a*–28*d* are provided in each of the rooms and are coupled at 29*a*–29*d* for control of displacement of a movable air flow control element, such as a vane, blade, disk or damper mounted within diffusers 27*a*–27*d* or in supply ducts 26*a*–26*d*. Diffusers 27*a*–27*d* are VAV devices and temperature sensors 28*a*, 28*b* and 28*d* are schematically shown as being mounted to or proximate their respective diffusers, but they also can be remotely mounted, as shown by wall-mounted temperature sensor 28*c*. The HVAC system also will include a return duct system schematically indicated at 30 that returns the air from each room 22*a*–22*d*, through intakes, schematically shown at 25. Since the present system adds ventilation air to the input to each room air, valves 35 and 45 are provided to divide the return air flow between return to supply air source 23 for recycling and return to the outside of structure 21, or to a filter system (not shown) for the creation of ventilation air.

Thus, central HVAC source 23 provides a volume of conditioned supply air to each of the branch ducts, and room air temperature sensors 28*a*–28*d* senses the average temperature in each of rooms 22*a*–22*d*. Having sensed the temperature, the VAV devices 27*a*–27*d* are opened or closed in response to input from the room air temperature sensors to accommodate the thermal demand. In a structure, such as building 21, rooms 22*a* and 22*b* may be on a sunny side of the building, while rooms 22*c* and 22*d* may be out of the direct sun. Similarly, various rooms may have varying numbers of occupants and/or computers and other office equipment and lighting which would create uneven thermal demand. Accordingly, each of the VAV devices 27*a*–27*d* are preferably independently operable to vary the volume of conditioned supply air discharged in accordance with the thermal load. As will be appreciated, in some systems a single room air temperature sensor controls more than one space, but this is generally not desirable in light of the likelihood of varying thermal loads.

As above noted, in some VAV systems ventilation air is merely taken in from an intake (not shown) to the HVAC equipment 23 and distributed through diffusers 27*a*–27*d* with the supply air. This, of course, has the attendant problem of not providing enough ventilation air to a room when the thermal load or demand in the room is very low.

In the variable-air-volume diffuser system of the present invention, ventilation air is taken in and distributed through an independently controlled or decoupled ventilation air system. Ventilation air ducts 46*a*–46*d* are connected to ventilation air nozzles 59 (FIGS. 2, 3 and 3A) provided in each VAV supply air diffuser 27*a*–27*d* at a position downstream of the diffuser supply air control vanes or blades 53 (seen in FIGS. 2, 3 and 3A). The advantage of positioning ventilation air ducts in the same diffusers providing supply air is that ventilation air is discharged independently of the volume of supply air discharged from the diffuser. Additionally, separate ventilation air diffusers are eliminated in the present system, as compared to prior art parallel ventilation systems.

As will be seen in FIG. 1, therefore, a ventilation air treatment unit, generally designated 41, is provided which has an air intake 42 located for the intake of ventilation air (VA) from a ventilation air source other than the supply air source 23, which can be the exterior of structure 21 or a ventilation filtering device (not shown) receiving return air through duct 30 and valve 45. A ventilation air duct 43 connects intake 42 with a ventilation air treatment unit 41 and a main ventilation air duct or conduit 44 extends to branch ventilation air ducts or conduits 46*a*–46*d*.

As shown in FIG. 1, therefore, each diffuser 27*a*–27*d* discharges a volume of supply air from source 23 which is determined by the average temperature in each of rooms 22*a*–22*d*. As shown in the drawing, the supply air (SA) volume being discharged into room 22*a* is 190 cfm, while the volume of supply air being discharged from diffuser 27*b* into room 22*b* is 240 cfm. Similarly, the VAV volume of supply air being discharged from diffuser 27*c* into room 22*c* is 70 cfm, while the VAV volume in room 22*d* is 80 cfm. Each of these volume discharge rates is determined by the respective average room air temperature being sensed by sensors 28*a*–28*d*.

Independently of the VAV supply air volume being discharged into each of the rooms, it also will be seen that ventilation air (VA) being discharged into each of the rooms is 20 cfm, with the exception that in room 22*d* 40 cfm of ventilation air is being discharged into the room. Thus, the assumption in the illustrated structure is that rooms 22*a*, 22*b* and 22*c* each have one occupant normally in the room, while room 22*d* has two occupants. The discharge rate of ventilation air, VA, to each of the rooms, however, is determined as a function of the occupancy, not as a function of thermal loading. Variation of the ventilation air discharge rate can be controlled, for example, by a modulation valve and valve actuator, such as valve and actuator 60*a* (FIGS. 1 and 3), mounted in each ventilation branch conduit 46*a*–46*d* and coupled at 80*a*–80*d* for control by controller 81. Differing ventilation flow rates also can be established by selection of the conduit sizes, conduit lengths and by selection of the sizes and number of discharge orifices.

In the system of FIG. 1, the ventilation-air-treatment unit 41 typically will be coupled at 82 to or include a controller 81 for controlling the temperature, humidity and flow rate of the ventilation air discharged into rooms 22*a*–22*d*. Thus, the ventilation air discharged through diffusers 27*a*–27*d* will most preferably be relatively neutral in its impact on the space being conditioned. For example, ventilation air can be heated and/or cooled to reduce the humidity and bring it to a temperature of about 72 degrees with a relative humidity in the range of 50%–60%. Humidifiers can be used in climates in which the outside air has a very low humidity. Unit 41 will also include a blower or fan which draws ventilation air in through intake 42 and forces it to the various diffusers 27*a*–27*d*. Such ventilation air treatment units are well known in the industry and will not be described further herein. Controller 81 also can be coupled at 83 to control operation of HVAC source equipment 23.

The supply of ventilation air into a space independently of the supply air through various types of VAV diffusers is contemplated, but it is highly advantageous to employ the present apparatus and method with thermally-powered VAV diffusers. Accordingly, further details of the present system will be described in connection with one form of thermally-powered VAV diffuser, as shown in FIGS. 2 and 3.

Figure 2:
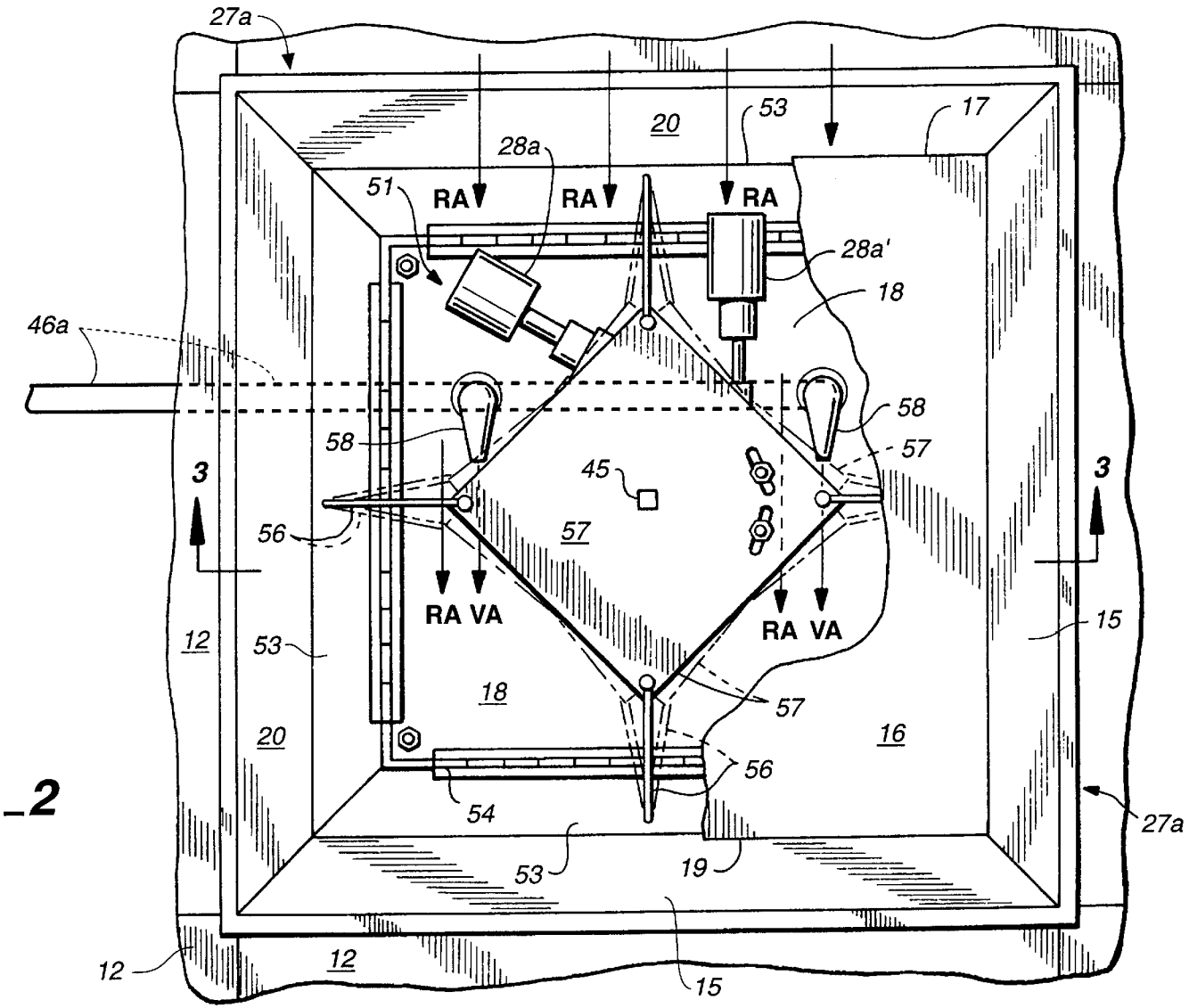
FIG. 2 is a bottom plan view, partially broken away, of a thermally-powered VAV diffuser assembly constructed in accordance with the present invention.
Figure 3:
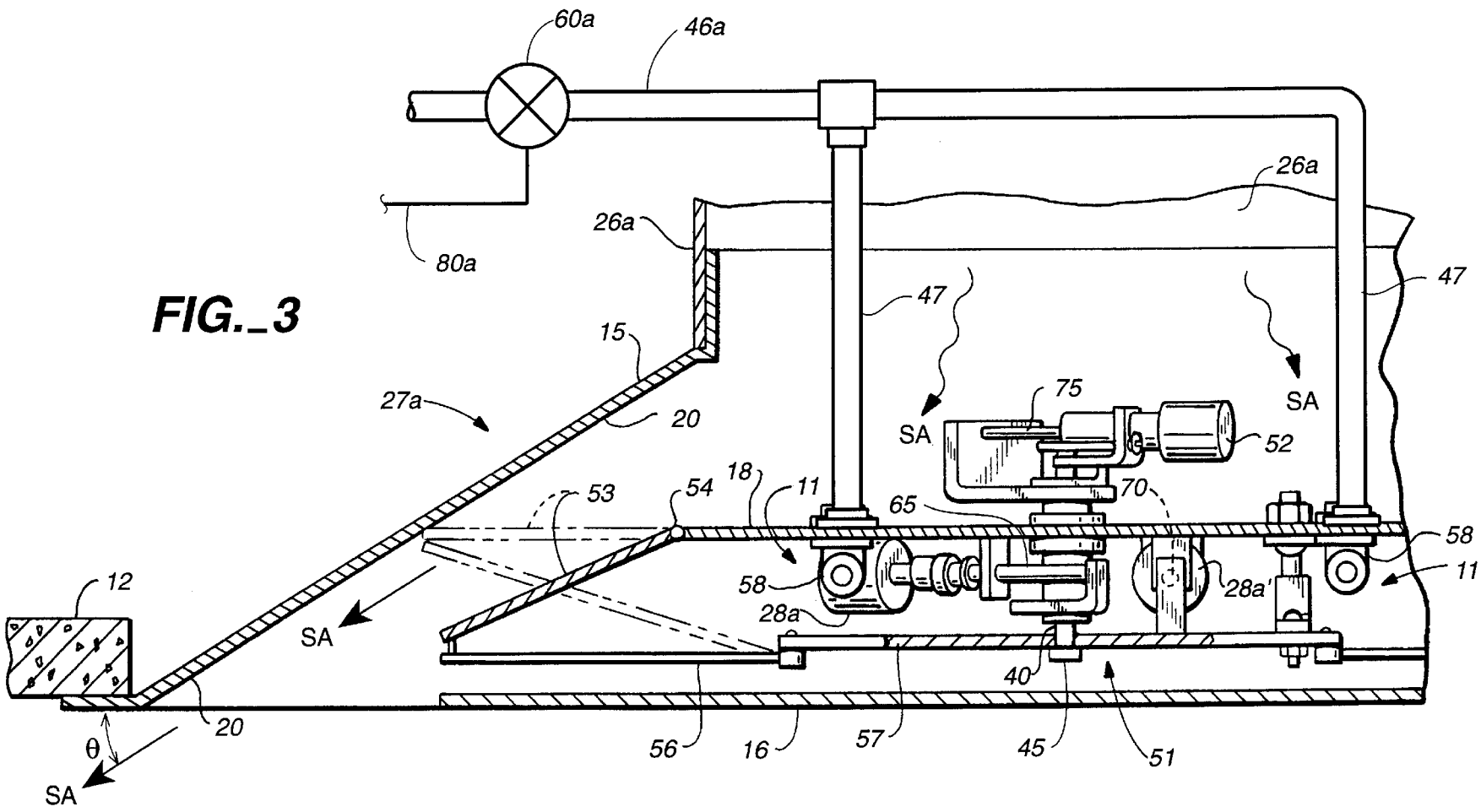
FIG. 3 is an enlarged, fragmentary, side elevation view in cross section of the assembly of FIG. 2.

A VAV diffuser 27*a* is shown in FIGS. 2 and 3 which includes a diffuser housing 15 formed for the discharge of supply air (SA) into the room or space to be air conditioned. Usually, diffuser 27*a* will be mounted in the ceiling, for example, in a modular ceiling in place of one of ceiling panels 12, and diffuser 27*a* will be coupled to a branch supply conduit 26*a*.

Extending across diffuser housing 15 will be a diffusion plate 18 which directs duct or supply air flow for discharge out of sides of the diffuser housing at an angle θ, preferably selected so as to achieve a Coanda effect, that is, to cause the diffused supply air to hug the ceiling and avoid dumping. Diffusion plate 18 is supported from housing 15 by brackets (not shown), and the diffusion plate also acts as a support structure for the operative components of the thermally-powered VAV diffuser.

In order to more accurately track or follow the average room air temperature, diffuser 27*a* preferably employs a room air flow induction arrangement which is formed and positioned to induce the flow of a certain amount of room air, as shown by arrows RA, between appearance panel 16 and diffusion plate 18. The space between the appearance panel and diffusion plate acts as an induction passageway 11 in which a portion of a thermal sensor-actuator assembly, generally designated 51, is positioned. Sensor-actuator assembly 51 includes a first thermal sensing-actuator 28*a*, a second thermal sensor-actuator 52 and a third thermal sensor-actuator 28*a*'. The first and third thermal sensor-actuators, 28*a* and 28*a*', are mounted below diffusion plate 18 and therefore are in a position to act as room air temperature sensors in induction passageway 11. The second thermal sensor-actuator 52 is mounted above diffusion plate. 18 and senses and is responsive to supply or duct air temperature.

The first, second and third thermal sensor-actuators can be of the type that are commonly in use in the air conditioning industry and sold, for example, by Acutherm, L.P. of Hayward, Calif., and described in more detail in U.S. Pat. Nos. RE 30,953, 4,491,270 and 4,523,173.

As best seen in FIG. 2, the volume of supply air discharged from VAV diffuser 27*a* is controlled by four movable air flow control elements, here vanes or blades 53, which are connected by hinges 54 to diffusion plate 18. Rods or spokes 56 connect vanes 53 to a diffuser control plate 57, which is rotatably mounted to diffusion plate 18 by shaft 40 and locknut 45. Sensor-actuator assembly 51 controls movement of plate 57. The diffuser control plate may rotate in either a clockwise or counter-clockwise direction (as shown by broken lines in FIG. 2), depending upon whether the diffuser is operating in a "heating mode" or a "cooling mode." Rotation of plate 57, therefore, controls the opening and closing of vanes 53. More specifically, when control plate 57 rotates in response an actuating force delivered by sensor-actuator assembly 51, each spoke 56 pulls an associated vane or blade downward away from inner surface 20 of the sidewalls of housing 15 to allow supply air to flow or be discharged into the room.

As best may be seen in FIG. 3, the various sensor-actuators 28*a*, 28*a*' and 52 are mounted to displace levers or arms coupled to, or rotatably mounted on, shaft 40 or plate 57. Thus, there is a linkage assembly in thermally-powered diffuser 27*a* which rotatably displaces plate 57 in response to the temperatures sensed by sensor-actuators 28*a*, 28*a*' and 52. The details of operation of the three sensor-actuators and the associated linkage assemblies required to open and close vanes 53 will not be described herein since they are described in detail in U.S. Pat. Nos. RE 30,953, 4,491,270 and 4,523,713, which are incorporated herein by reference. It is sufficient to state that expansion of a wax material inside sensor-actuators 28*a*, 28' and 52 produces outward displacement of pistons 65, 70 and 75, respectively, which displacement is converted by the linkage assembly into rotation of shaft 42 in the desired direction and rotation of control plate 57 so as to produce opening and closing of vanes 53.

The VAV diffuser of FIGS. 2 and 3 further includes at least one induction air nozzle 58, which is arranged and constructed to induce the flow of room air (RA) in induction channel 11 past room air temperature sensor-actuators 28*a* and 28*a*'. In the preferred form two nozzles 58 are shown mounted to diffusion plate 18, but nozzles 58 also could be mounted to housing 15, as long as they induce room air flow over a room air temperature sensor, such as thermal sensor-actuators 28*a* and 28*a*'.

In my prior copending application, air induction conduit 46*a* was coupled to induction air nozzles 58 so that ventilation air could be discharged through nozzles 58. In diffuser of the present invention, supply air (SA) is discharged through nozzles 58 since even when blades or vanes 53 are in a fully closed position, supply air (SA) will be present at the inlets 58*a* on the upstream side of diffusion plate 18.

As supply air (SA) is discharged from nozzles 58, room air (RA) will be pulled through passageway 11 from one side thereof, as best may be seen in FIG. 2, namely, the top side in FIG. 2. In order to reduce the corruption or influence of duct air on the other side of diffusion plate 18, it is advantageous if the room air sensors 28*a* and 28*a*' are located proximate a side of appearance panel 16 from which room air, RA, will enter induction channel 11. Thus, the room air, RA, entering channel 11 at the top side 17 of appearance plate 16 will not be heated or cooled by duct or supply air, SA, through diffusion plate 18 before it passes over the two room air temperature sensors 28*a*, 28*a*'. This ensures more accurate average room air temperature tracking.

In any event, it will be apparent that, even when vanes 53 are in the fully closed position, shown in phantom lines in FIG. 3, supply air, SA, will be discharged from nozzles 58 ensuring a continuous flow of room air, RA, through channel 11 and across room air temperature sensor-actuators 28*a* and 28*a*'.

Moreover, whether vanes 53 are either in the fully closed or fully opened position, as shown in FIG. 3, or at other positions therebetween, ventilation air, VA, will be discharged through ventilation air conduit branch 46*a* from ventilation air opening defining devices 59, which may take the form of a nozzle, orifice or other opening or aperture defining structure. The use of an opening defining structure 59 which is in the form of a nozzle suitable for inducing the flow of surrounding air, such as nozzle 58, is not required for the ventilation air opening 59 of FIGS. 2 and 3. Opening defining device 59 is not being used in this embodiment to induce room air flow, which is accomplished by nozzles 58. As seen in FIGS. 2 and 3, ventilation air opening defining devices 59 are merely positioned in housing 15 downstream of vanes or blades 53. The positioning of ventilation air nozzles or openings in the diffuser housing downstream of the diffuser vanes or blades 53 ensures that ventilation air (VA) will be discharged into each room independently of the flow of supply air (SA) is flowing into the room. The ventilation air entering the room, therefore, can be set at any predetermined level and controlled by valve 60*a* independently of the flow of supply air which is controlled by the room's thermal loading. The level of ventilation air can be selected to be sufficient to meet ASHRAE Standards, or any other desired local standard based upon room occupancy. Notwithstanding any variation of the volume of supply air discharge, therefore, the volume of ventilation air discharged into each room will be decoupled from or independently maintained at the desired occupancy-driven threshold.

Since VAV diffusers often are provided with air induction nozzles 58 which are in fluid communication with supply air, SA, it is quite possible to retrofit existing systems by simply attaching a branch ventilation conduit 47 through housing 15 and/or duct 26*a* to ventilation air nozzles 59. Thus, a single diffuser now is capable of decoupled control of both ventilation air, VA, and variable-air-volume supply air, SA, into a room. As will be seen, discharge of ventilation air, VA, into the room also advantageously is at an angle θ which achieves the Coanda effect.

Figure 3A:
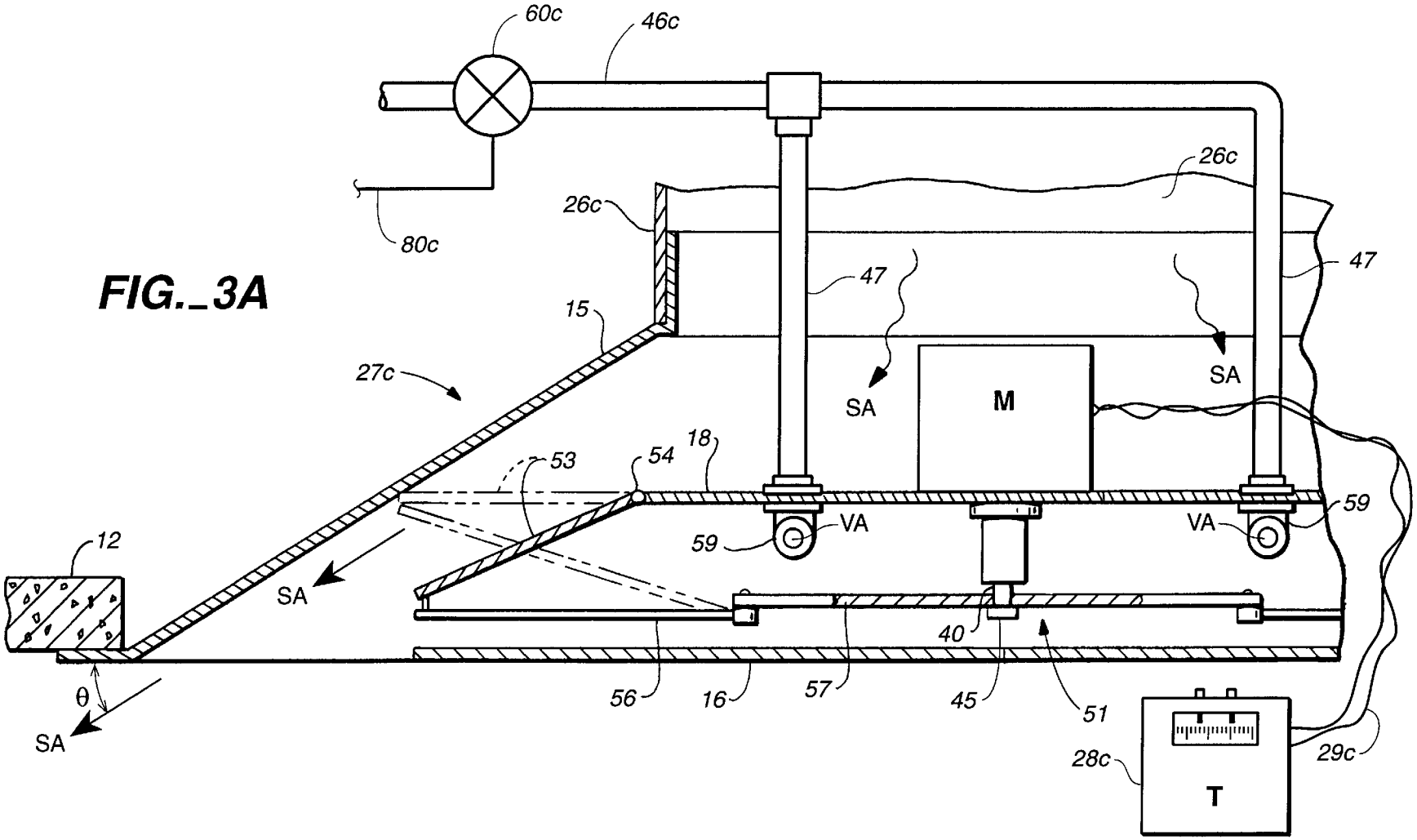
FIG. 3A is an enlarged, fragmentary, side elevation view in cross section of an alternative embodiment of the VAV diffuser of FIGS. 2 and 3.

An alternative embodiment of the VAV diffuser of FIGS. 2 and 3 is shown in FIG. 3A, in which the same reference numerals are used on components which may essentially be the same as the diffuser of FIGS. 2 and 3.

In FIG. 3A, a diffuser 27*c* is coupled to supply conduit 26*c* for receipt of supply air, SA. Again, the diffuser may include a diffuser plate 18, movable blades 53 which are hinged at 54 to plate 18 and an appearance panel 16. Instead of a sensor-actuator assembly 51, VAV diffuser 27*c* includes an electrical or pneumatic motor, M, which is coupled to rotate shaft 40 connected by lock nut 45 to plate 47. The ends of rotatable plate 57 are connected to spokes 56, which in turn open and close blades or vanes 53.

In the embodiment of FIG. 3A, a wall-mounted room air temperature sensor 28*c* (or thermostat T) is mounted remotely of diffuser housing 15, as shown in FIG. 1 in room 22*c*. Thermostat T is coupled at 29*c* to control operation of Motor M, which also is connected to a power source, not shown, such as a source of electricity. As the room air is sensed to fall outside the range set at thermostat T, motor M is controlled to rotate shaft 40 in a direction either opening or closing blades 53 for modulation of the amount of supply air discharged into room 22*c*.

Independent discharge of ventilation air VA is accomplished by coupling of ventilation air conduit 46*c* to branches 47 for discharge out opening defining devices 59 downstream of movable blades 53. Here, nozzles 59 are mounted on diffusion plate 18 for discharge of ventilation air on the room side of the diffusion plate. The rate of discharge of ventilation air VA is independent of the supply air and is controlled by valve 60*c* through conductor 80*c* to controller 81.

It will be apparent from the above description of the apparatus of the present invention that the present invention also includes a method of ensuring the flow of ventilation air into a room of a structure. This method is comprised of the step of discharging ventilation air (VA) obtained from a ventilation air source other than the supply air source, such as an outside air intake or a filter system, through a ventilation air opening defining device 59 positioned in diffuser 27*a*–27*d* downstream of its vanes or blades 53. The discharging step is accomplished by discharging ventilation air into the room at a volumetric rate which is independent of, or decoupled from, the volumetric rate of the discharge of supply air into the room. Additionally, the discharging step can be accomplished when substantially no supply or duct air is being discharged through the diffuser, and most conventionally, the discharge rate of ventilation air through the air induction nozzle will be substantially constant, while the discharge rate of supply air will vary.

What is claimed is:

1. A variable-air-volume conditioning system comprising:

a diffuser housing formed for coupling to a supply air conduit and defining a discharge opening for discharge of supply air from a supply air source into a room of a structure;

an air flow control element movably mounted for control of the volume of supply air discharged from said diffuser housing through said discharge opening;

a room air temperature sensor;

an air flow control element displacement device coupled to said room air temperature sensor and responsive to input from said temperature sensor to move said air flow control element;

a ventilation air opening defining device mounted to said diffuser housing in a position to discharge ventilation air into said housing at a position downstream of said air flow control element; and a ventilation air assembly separate from said supply air source and coupled to said opening defining device for discharge of ventilation air through said opening defining device into said diffuser housing for discharge out said discharge opening into said room.

2. The variable-air-volume conditioning system as defined in claim 1 wherein, said ventilation air assembly is provided by a ventilation conduit assembly connected to a ventilation air treatment and blower assembly fluid coupled to said ventilation conduit assembly.

3. The variable-air-volume conditioning system as defined in claim 1 wherein, said ventilation air opening defining device is provided by an air nozzle formed to discharge ventilation into said room in a volume which is independent of the volume of supply air discharged into said room through said discharge opening.

4. The variable-air-volume diffuser as defined in claim 1 wherein, said ventilation air supply assembly is formed to discharge ventilation air into said room through said opening defining device when said air flow control element is in a closed position substantially reducing the discharge of supply air from said diffuser.

5. The variable-air-volume diffuser as defined in claim 1 wherein, said room air temperature sensor is mounted in said diffuser housing.

6. The variable-air-volume diffuser as defined in claim 1 wherein, said room air temperature sensor is mounted remote of said diffuser housing.

7. A variable-air-volume diffuser comprising:

a diffuser housing coupled to a supply air conduit and formed with a discharge opening for discharge of supply air from a supply air source into a room of a structure;

a room air temperature sensor mounted in a position for sensing room air temperature;

an air flow control element mounted to said housing for movement between a closed position to an open position to enable variation of the volume of supply air discharged from said diffuser through said discharge opening;

a displacement device coupled to said temperature sensor and coupled to said air flow control element, said displacement device being responsive to input from said temperature sensor to move said air flow control element to modulate the discharge of supply air from said diffuser;

a supply air nozzle mounted to said housing in a position inducing room air flow past said temperature sensor upon discharge of air from said supply air nozzle; and a ventilation air assembly coupled to a ventilation air nozzle positioned downstream of said air flow control element and having a ventilation air intake located for intake of ventilation air from a ventilation air source separate from said supply air source, said ventilation air assembly being further formed to cause ventilation air to flow from said intake to said ventilation air nozzle for discharge out said diffuser.

8. The variable-air-volume diffuser as defined in claim 7 wherein, said displacement device is a thermal sensor-actuator assembly including said room air temperature sensor mounted in said housing as an element thereof.

9. The variable-air-volume diffuser as defined in claim 7 wherein, said displacement device is provided by a motor, and said room air temperature sensor is mounted remotely of said housing.

10. A method of ensuring a flow of ventilation air into a room of a structure, said room receiving conditioned air from a variable-air-volume diffuser coupled to a supply air source, comprising the step of:

discharging ventilation air obtained from a ventilation air source separate from said supply air source through an ventilation air opening defining device located downstream of a supply air flow control element in said diffuser housing.

11. The method as defined in claim 10 wherein, said discharging step is accomplished by discharging ventilation air into said room at a volumetric rate independent of the volumetric rate of discharge of supply air into said room.

12. The method as defined in claim 11 wherein, said rate of discharge of said ventilation air through said ventilation air nozzle is substantially constant.

13. The method as defined in claim 11 wherein, said discharging step is accomplished when supply air being discharged through said diffuser is substantially reduced.

* * * * *